United States Patent [19]

Lockett, Jr.

[11] 4,164,202

[45] Aug. 14, 1979

[54] STEAM GENERATION

[75] Inventor: William Lockett, Jr., Basking Ridge, N.J.

[73] Assignee: Exxon Research & Engineering Co., Florham Park, N.J.

[21] Appl. No.: 893,064

[22] Filed: Apr. 3, 1978

[51] Int. Cl.[2] ..... F22B 1/16

[52] U.S. Cl. ..... 122/31 R; 261/117

[58] Field of Search ..... 122/31 R; 159/48, DIG. 33; 261/18, 115, 117, 76

[56] References Cited

U.S. PATENT DOCUMENTS

| | | | |
|---|---|---|---|
| 2,182,428 | 12/1939 | Fladmark | 159/48 |
| 2,222,575 | 11/1940 | Schutte | 122/31 |
| 2,868,523 | 1/1959 | Candiff et al. | 122/31 |
| 3,332,401 | 7/1967 | Lustenader | 122/31 |
| 3,409,274 | 11/1968 | Lawton | 261/76 |

*Primary Examiner*—Kenneth W. Sprague

*Attorney, Agent, or Firm*—Marthe L. Gibbons

[57] ABSTRACT

A method of controlling the rate of generating steam by direct heat exchange is provided in which a spray of hot oil drops contacts a spray of water drops. Large water drops are prevented from entering the effluent oil stream during upsets in operating conditions by providing suitable disengaging means such as heated sloped baffles below the contacting zone.

13 Claims, 1 Drawing Figure

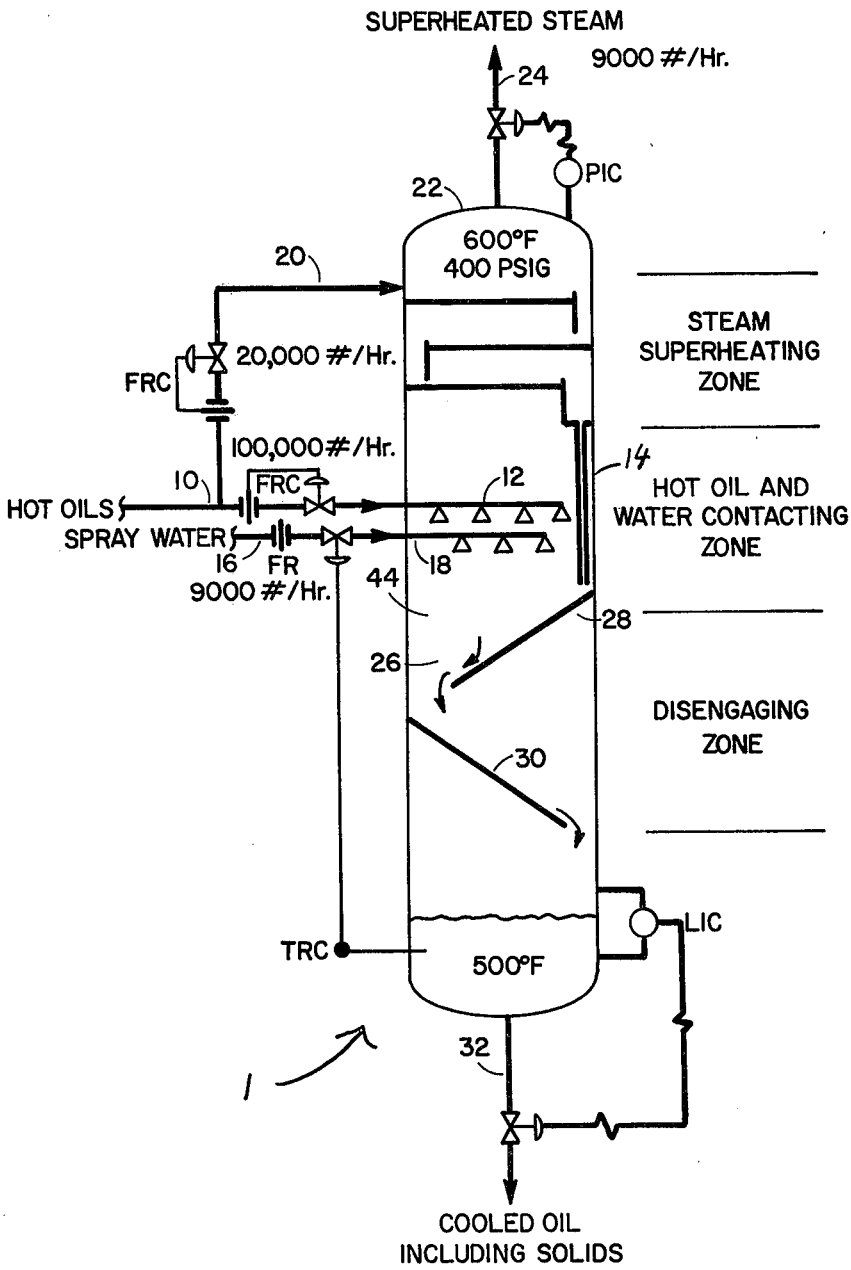
SUPERHEATED STEAM
9000 #/Hr.
24
PIC
22
600°F
400 PSIG
20
STEAM
SUPERHEATING
ZONE
FRC
20,000 #/Hr.
100,000#/Hr.
14
10
FRC
12
HOT OIL AND
WATER CONTACTING
ZONE
HOT OILS
SPRAY WATER
16
FR
9000 #/Hr.
18
44
28
26
DISENGAGING
ZONE
30
LIC
TRC
500°F
32
1
COOLED OIL
INCLUDING SOLIDS

STEAM GENERATION

BACKGROUND OF THE INVENTION

1. Field of the Invention

The present invention relates to an improved method of generating steam by direct heat exchange of water and a hot heat transfer liquid, such as a hot oil.

2. Description of the Prior Art

It is known to generate steam by direct contact of a water spray with a high temperature fluid, such as a fuel oil (see, for example, U.S. Pat. No. 2,222,575).

A method for the separation of solids from liquids is also known in which the heat transfer medium, which may be a hot oil or tar, is contacted with solids-containing water which is provided as a spray. Steam is recovered from the top of the apparatus leaving the solids suspended in the heat transfer medium (see, for example, U.S. Pat. No. 2,182,428).

A method of steam generation has now been found which has certain advantages that will become apparent in the ensuing description.

SUMMARY OF THE INVENTION

In accordance with the invention there is provided a process for controlling the rate for producing steam which comprises: contacting a spray of liquid water drops with a spray of hot substantially non-volatile liquid drops in a contacting zone to produce steam by direct heat exchange of said hot liquid and said water, said water drops having a mean average diameter of about one half the size of the mean average diameter of said hot liquid drops.

BRIEF DESCRIPTION OF THE DRAWING

The FIGURE is a schematic flow plan of one embodiment of the invention.

DESCRIPTION OF THE PREFERRED EMBODIMENT

The preferred embodiment will be described with reference to the accompanying drawing.

Referring to the figure, a stream of a hot substantially non-volatile liquid is introduced by line 10 into vessel 1 wherein are disposed spray nozzles 12 in contacting zone 14. The term "substantially non-volatile" liquid is used herein to designate a liquid which does not readily vaporize under the operating conditions. Suitable substantially non-volatile liquids for use as hot heat transfer medium include mineral oils such as hydrocarbonaceous oils which may be derived from petroleum, tar sand, shale, coal liquefaction processes and the like. Preferably, the substantially non-volatile liquid is a heavy hydrocarbonaceous oil. The rate of heat exchange in the contacting zone is a function of the contacting surface and relative volumes of the hot liquid and water being sprayed. The spraying pressure determines the quantity and mean average droplet size. The dense mist produced by the hot liquid spray limits the quantity of hot liquid for heat exchange and the fine water spray controls the amount of heat transfer. The mean average size of the water drops should be about one half the diameter of the mean average size of the hot substantially non-volatile liquid drops. This relative particle size provides enough sensible heat in the hot substantially non-volatile liquid drop to vaporize a water drop.

The hot substantially non-volatile liquid will emerge as droplets from the spray nozzles disposed in the contacting zone. A major portion, that is, at least 50% of the droplets, preferably at least 85% of the hot liquid droplets will emerge from the spray nozzles as droplets having a diameter ranging from about 500 to about 5000 microns. Suitable temperature of the hot liquid which is in line 10, at the point of entry into vessel 1, will include a temperature ranging from about 300° to about 750° F., preferably from about 650° to about 675° F.

A stream of water in liquid phase is introduced into vessel 1 by line 16 through spray nozzles 18. The water emerges from spray nozzles 18 as liquid droplets. Suitable particle diameter size of the liquid droplets emerging from the spray nozzles include droplets of which at least 50% have a diameter ranging from about 250 to about 2500 microns.

Suitable liquid water streams include relatively pure water, sour water streams recovered from various processes including petroleum refining processes, boiler feed water. The water stream may include various amounts of solid contaminants, for example, coke fines which may be present in waste water streams.

Contact of the liquid water droplets with the hot liquid droplets occurs in the contacting zone. The sensible heat of the hot liquid droplets upon contact with the liquid water droplets causes the water to be converted to steam. Furthermore, if solids are present in the water stream, most of those solids will pass into the substantially non-volatile liquid phase.

The hot liquid stream is introduced into vessel 1 at a rate and amount and at a temperature sufficient to produce the desired amount of steam. For example, when the hot liquid is a hot oil, a suitable flow of hot oil into the contacting zone is 100,000 pounds per hour to cool the oil from 650° F. to 500° F. The heat exchanged, at these conditions, will generate about 9000 pounds per hour of 400 psig steam. The quantity of steam generated is controlled by the temperature of the recovered substantially non-volatile liquid. The steam that was generated in the contacting zone flows upwardly into the upper portion of the vessel into zone 22 where, optionally, it may be superheated, for example, by introducing a portion of the hot substantially non-volatile liquid via line 20 into zone 22, which then becomes a superheating zone. The hot liquid in this zone also recovers particulates, if present in the steam. The steam or superheated steam leaves vessel 1 overhead via line 24. A rate of 20,000 pounds per hour of hot substantially non-volatile liquid will provide about 170° F. of superheat.

The substantially non-volatile liquid droplets which have contacted the liquid water have given up their sensible heat and are, thereby, cooled substantially non-volatile liquid droplets which fall into disengaging zone 26 wherein any entrained steam or water droplets become separated from the substantially non-volatile liquid.

In the disengaging zone may be positioned a contacting surface, such as sloped baffles 28 and 30 which are heated to a temperature well above the steam dew point by warm liquid leaving the contacting and superheating zones. The substantially non-volatile liquid which falls downwardly contacts the baffles which serve as aid in disengaging any water and/or entrained steam from the substantially non-volatile liquid phase. Since the presence of entrained water in the substantially non-volatile liquid phase in the liquid reservoir in the bottom of the vessel is undesirable because it may lead to hazardous conditions, for safety of operation, separation or removal of any entrained water from the substantially non-volatile liquid should be performed. The cooled substantially non-volatile liquid including any solids that may have been present initially in the water stream is removed from vessel 1 by line 32.

The pressure in vessel 1 is not critical and may vary widely. Suitable pressure ranges include a pressure from about 20 to about 600 psig, depending on the temperature of the hot substantially non-volatile liquid introduced into the vessel.

What is claimed is:

1. A process for controlling the rate of production of steam, which comprises: contacting a spray of liquid water drops with a spray of hot substantially non-volatile liquid drops in a contacting zone to produce steam by direct heat exchange of said hot liquid and said water, said water drops having a mean average diameter of about one half the size of the mean average diameter of said hot liquid drops.

2. The process of claim 1 wherein said water spray comprises solids.

3. The process of claim 1 wherein said hot substantially non-volatile liquid is a hot oil.

4. The process of claim 2 wherein said hot oil is a hydrocarbonaceous oil.

5. The process of claim 1 wherein at least 50% of the drops of said substantially non-volatile liquid spray have a particle size ranging from about 500 to about 5000 microns in diameter.

6. The process of claim 1 wherein at least 50% of the drops of said water spray have a particle size ranging from about 250 to about 2500 microns in diameter.

7. The process of claim 1 wherein said hot substantially non-volatile liquid drops have an initial temperature ranging from about 300° to about 700° F.

8. A process for controlling the rate of production of steam, which comprises:

(a) introducing into a contacting zone a stream of hot mineral oil as a spray of drops;

(b) introducing into said contacting zone a separate stream of liquid water as a spray of drops, said water drops having a mean average diameter of about one half the size of the mean average diameter of said hot mineral oil drops;

(c) contacting said hot oil drops with said liquid water drops in said contacting zone to produce steam;

(d) separating said steam from said oil;

(e) recovering said steam, and (f) recovering a cooled oil.

9. The process of claim 8, wherein after said contacting step, said oil is passed to a disengaging zone to remove any entrained water from said oil prior to recovering the cooled oil.

10. The process of claim 9 wherein said disengaging zone comprises heated sloped baffles means, and wherein the recovered cooled oil is substantially water-free.

11. The process of claim 8 wherein said water stream comprises solids and wherein said cooled oil recovered in step (f) comprises said solids.

12. The process of claim 8 wherein prior to recovering said steam, the steam is additionally heated to produce superheated steam.

13. The process of claim 8 wherein at least 50% of the drops of said oil spray have a particle size ranging from about 500 to about 5000 microns in diameter.

* * * * *